United States Patent [19]

Troescher, Jr.

[11] Patent Number: 4,977,677

[45] Date of Patent: Dec. 18, 1990

[54] TARGETING DEVICE

[76] Inventor: Robert H. Troescher, Jr., 33 Abrams Pl., Lynbrook, N.Y. 11563

[21] Appl. No.: 438,674

[22] Filed: Nov. 20, 1989

[51] Int. Cl.[5] ..... F41G 1/467

[52] U.S. Cl. ..... 33/265; 33/241; 124/87

[58] Field of Search ..... 33/265, 241; 124/87

[56] References Cited

U.S. PATENT DOCUMENTS

| | | | |
|---|---|---|---|
| 2,171,571 | 9/1939 | Karnes | 33/241 |
| 2,339,723 | 1/1944 | Russell | 33/241 |
| 2,392,979 | 1/1946 | Douden | 33/241 |
| 2,527,043 | 10/1950 | Wallhausen | 33/241 |
| 3,121,163 | 2/1964 | Rickert | 33/241 |
| 4,495,705 | 1/1985 | Kowalski et al. | 124/87 |
| 4,554,744 | 11/1985 | Huckenbeck | 33/241 |
| 4,638,565 | 1/1987 | Podany et al. | 33/265 |
| 4,792,673 | 12/1988 | Blackler | 33/241 |
| 4,877,324 | 10/1989 | Hauri et al. | 33/241 |

FOREIGN PATENT DOCUMENTS

| | | | |
|---|---|---|---|
| 2154332 | 9/1985 | United Kingdom | 33/241 |

*Primary Examiner*—Thomas B. Will

*Attorney, Agent, or Firm*—Joseph M. Maguire

[57] ABSTRACT

A targeting device comprising a transparent casing having a circumferential wall formed with circumferentially aligned openings. A transparent lens is enclosed by and in firm contact with the circumferential wall of the casing, has it circumferential surface disposed directly opposite the opening in the casing, and has one of its plane surfaces formed with a reticle of reflective material. Light emitting diodes are disposed in the casing openings and are connected to a power source. Coating material is provided on the casing for inhibiting light from escaping from the casing, while intensifying reflection of light from the diodes into the casing and then into the lens for illumination of the reticle.

8 Claims, 2 Drawing Sheets

TARGETING DEVICE

BACKGROUND OF THE INVENTION

This invention relates to a targeting device and, more particularly, to an illuminated targeting device for an archery bow.

While it is common for archers to use illuminated sights for aiming of an arrow, particularly during dim light periods like early morning or late evening, such sights are subject to one or more disadvantages with respect to price, durability, reliability, or complexity and its attendant problem of upset in shooting concentration.

SUMMARY OF THE INVENTION

The general object of the present invention is the provision of a targeting device possessing the virtues of compactness, light-weight, simplicity, reliability, durability, and inexpensiveness. A further and more specific object of the invention is the provision of a targeting device of the type described which is characterized by an arrangement which permits sighting of a target in dim light conditions, is easily attached to and detached from the equipment with which it is used, and affords proper aiming and high accuracy. While the device of the invention is specifically designed for use by an archer, it may be used on other equipment where a projectile is aimed at a target.

In accordance with the invention, the targeting device comprises a transparent casing having a circumferential wall formed with circumferentially aligned openings. A transparent lens is enclosed by and secured to the casing, has its circumferential surface disposed directly opposite the openings in the circumferential wall of the casing, and has one of its side walls formed with a reticle of reflective material. Light emitting diodes are disposed in the casing openings and are connected to a power source. Coating material is provided on the casing for inhibiting light from escaping from the casing, while intensifying reflection of light from the diodes into the casing and then into the lens for illumination of the reticle.

BRIEF DESCRIPTION OF THE DRAWINGS

Further objects and advantages will become apparent from the following description and claims and from the accompanying drawings, wherein:

DESCRIPTION OF THE PREFERRED EMBODIMENT

Figure 1:
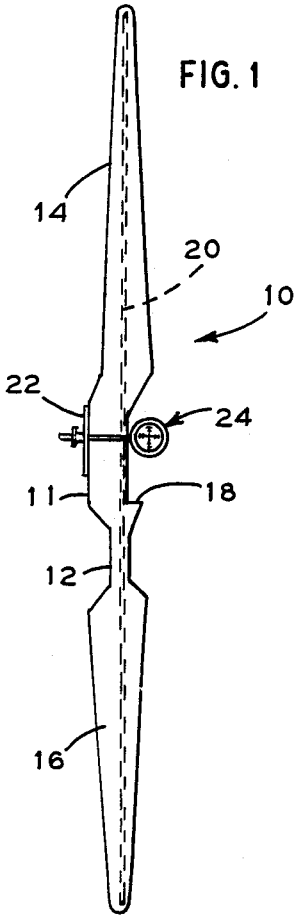
FIG. 1 is an elevational view of a bow provided with a bowsight of the present invention.

FIG. 1 shows a conventional bow 10 including a central body portion 11, a grip 12 beneath portion 11, and upper and lower arms 14 and 16, respectively, that extend upwardly and downwardly from portion 11. Above grip 12 there is a receiving area 18 for an arrow that is engaged with a string 20. When the string is pulled away from portion 11, arms 14 and 16 bend to provide a force for propelling the arrow. Secured to the side of portion 11 by means of a bracket 22 is a bowsight 24 of the present invention.

Figure 2:
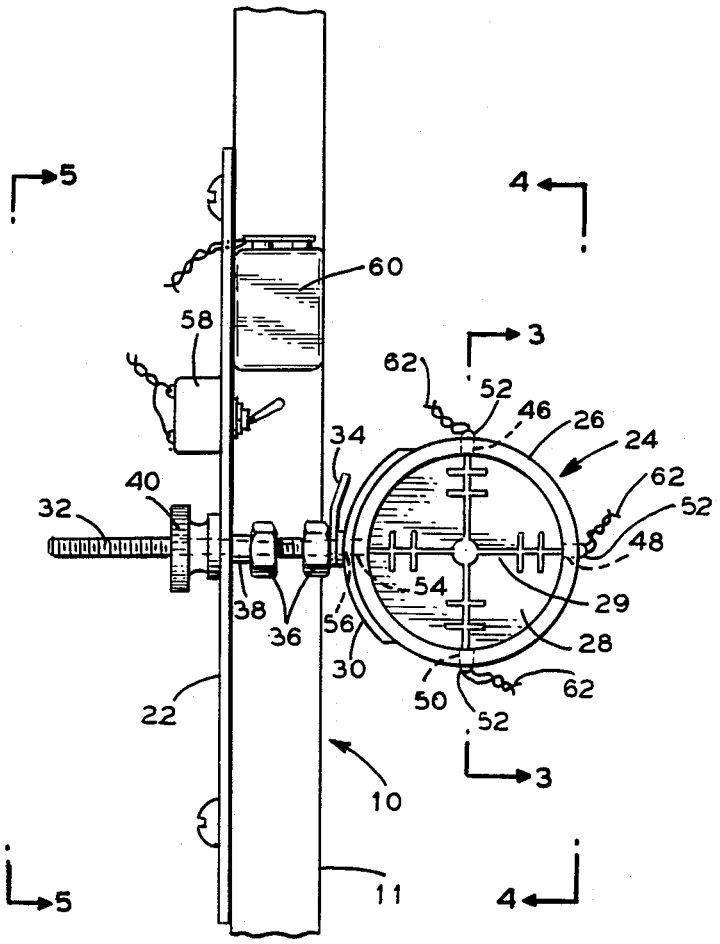
FIG. 2 is an enlarged view of the bowsight of FIG. 1.

As shown in FIG. 2, bowsight 24 includes a tubular transparent casing 26, and a circular transparent lens 28 enclosed by and in firm contact with casing 26 and having one of its side surfaces formed with a reticle 29 of reflective material. Support for the bowsight includes an arc-shaped brace 30 attached to the outer surface of the circumferential wall of casing 26, a threaded rod 32 secured at one end to brace 30 and casing 26 and passing through ground terminal 34, stabilizing nuts 36, collar 38, bracket 22, and adjustment nut 40, with bracket 22 having a slot 42 for vertical adjustment of sight 24. Nuts 36 and 40 and collar 38 cooperate on rod 32 to secure sight 24 to bracket 22, while bracket 22 is fastened to the central body portion 11 of the bow.

Figure 3:
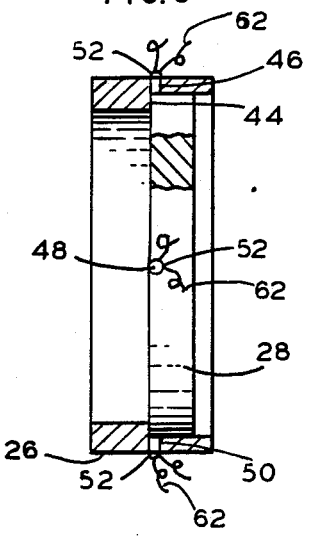
FIG. 3 is a sectional view taken along the line 3—3 of FIG. 2.

With reference to FIGS. 2 and 3, the inner surface of the circumferential wall of casing 26 is provided with a seat 44 for lens 28, the seat being formed by partial axial milling of the inner surface of the circumferential wall of the casing. The milled portion of the circumferential wall is formed with openings 46, 48 and 50 spaced 90° apart, located contiguous to seat 44, and occupied by light-emitting diodes 52; while the unmilled portion of the circumferential wall is formed with a threaded opening 54 spaced 90° from each of the openings 46 and 50. Brace 30 is secured to the outer surface of the circumferential wall of casing 26 at a position intermediate openings 46 and 50 and is formed with a threaded opening 56 in alignment with opening 54 for securement of rod 32 to brace 30 and casing 26.

Figure 5:
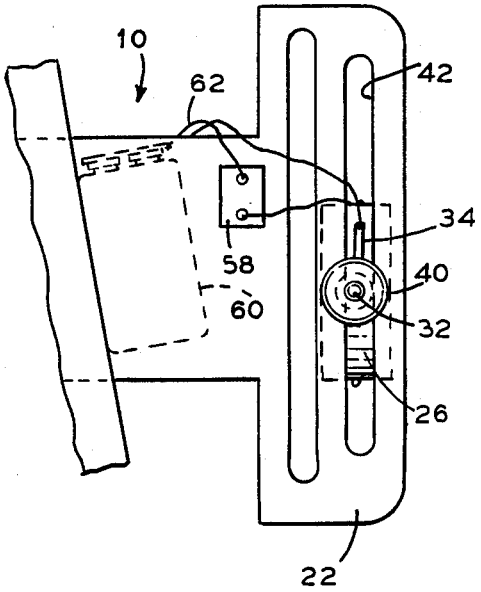
FIG. 5 is an elevation view taken along the line 5—5 of FIG. 2.
Figure 4:
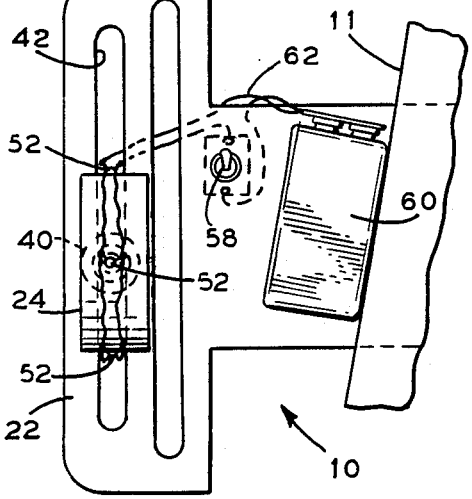
FIG. 4 is an elevation view taken along the line 4—4 of FIG. 2.
Figure 6:
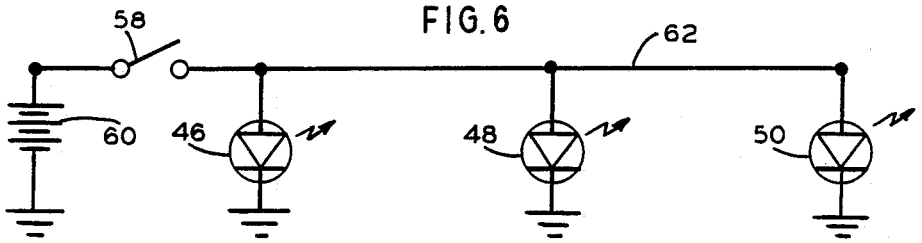
FIG. 6 is a schematic diagram of the electrical circuitry of the bowsight.

In accordance with the invention, before lens 28 is inserted into casing 26, coating material is applied to casing 26 to inhibit light from escaping from casing 26 when diodes 52 are in operation and to intensify reflection of light from the diodes into casing 26 and then into lens 28 for illumination of reticle 29. This is accomplished by applying two coats of paint, first a white coat and then a black coat, to all the surfaces of casing 26 except the portion to which brace 30 is attached and that portion of the milled inner circumferential wall including openings 46, 48 and 50 and directly facing and contacting the circumferential surface of lens 28. After casing 26 is so coated, diodes 52 are inserted into openings 46, 48 and 50, secured in the openings by epoxy resin and connected in parallel by wires 62 to one side of a switch 58, as shown in FIG. 6, with the other side of switch 58 being wired to a nine volt battery 60. Then lens 28 is inserted into casing 26 with its reticle surface applied to seat 44 and with its circumferential surface directly facing diodes 52 and in firm contact with the uncoated milled inner surface of the circumferential wall of casing 26. With reference to FIGS. 4 and 5, both switch 58 and battery 60 are mounted on and secured to bracket 22.

By way of example, and not of limitation, tubular casing 26 is made of transparent plastic, has an outside diameter of 1.5" (3.81 cm), an inside diameter at its milled portion of 1.4" (3.56 cm) and 1.26" (3.20 cm) at its unmilled portion, and a length of 0.60" (1.52 cm). The openings 46, 48 and 50 for diodes 52 are 0.130" (0.33 cm) in diameter and are spaced 90° apart. Lens 28 has an outside diameter of 1.3995" (3.55 cm) and a length of 0.145" (0.37 cm), with one side surface of the lens being formed with a reticle of red reflective paint.

The color red is preferred-because during the day it stands out, preventing the archer from losing sight of the cross hairs while lining up the target; and at night or in dim lighting conditions it doesn't t bother the archer's natural night vision.

In operation, when using the bowsight of the invention in poor light areas or low to no light situations, switch 58 is activated to provide energy from battery 60 to diodes 52 which direct light into casing 26 between the outer and inner surfaces of its circumferential wall, with the coating of white paint on the casing intensifying reflection of light from diodes 52 into the casing and then into lens 28 by way of its circumferential surface for illumination of the painted reticle 29.

I claim:

1. A targeting device comprising:

a transparent casing having a circumferential wall the circumferential wall having inner and outer surfaces and being formed with at least one opening, a transparent lens having two opposite plane surfaces and a circumferential surface, the lens being enclosed by and in firm contact with the inner surface of the circumferential wall of the casing, having its circumferential surface disposed directly opposite said opening, and having one of its plane surfaces formed with a reticle of reflective material, at least one light source, said light source being disposed in said opening, an energy source connected to said light source, and coating means on the casing for inhibiting light from escaping from the casing while intensifying reflection of light from the light source into the casing between the inner and outer surfaces of said circumferential wall and then into the lens by way of said circumferential surface for illumination of the reticle.

2. The device of claim 1 wherein the casing is tubular and said at least one opening includes three opening spaced from one another in said circumferential wall, said at least one light source includes three light sources, one of said three light sources being disposed in each of the openings, the energy source is connected to each of the light sources, the lens is circular and has said circumferential surface disposed directly opposite the openings and in firm contact with the inner surface of the circumferential wall of the casing, and the coating means intensifies reflection of light from the light sources into the casing.

3. The device of claim 2 wherein the light sources are light emitting diodes.

4. The device of claim 1 wherein the reticle is formed by red paint.

5. The device of claim 1 wherein the inner surface of the circumferential wall of the casing is formed with a seat for the lens.

6. The device of claim 1 wherein the coating means includes a layer of black paint on top of a layer of white paint.

7. The device of claim 1 wherein the casing and lens are formed by plastic material.

8. The device of claim 1 in combination with an archery bow having a central body portion wherein means are provided to secure the device to the central body portion of the bow including an arc-shaped brace attached to the outer surface of the circumferential wall of the casing.

* * * * *